US005406169A

United States Patent [19]

Son

[11] Patent Number: 5,406,169

[45] Date of Patent: Apr. 11, 1995

[54] ELECTRODE OF ELECTRON GUN FOR CATHODE RAY TUBE

[75] Inventor: Wan-Jae Son, Kyungki-Do, Rep. of Korea

[73] Assignee: Samsung Electron Devices Co., Ltd., Kyungki-Do, Rep. of Korea

[21] Appl. No.: 969,977

[22] Filed: Nov. 2, 1992

[30] Foreign Application Priority Data

Mar. 26, 1992 [KR] Rep. of Korea ..... 92-4774

[51] Int. Cl.[6] ..... H01J 29/48

[52] U.S. Cl. ..... 313/414; 313/417; 313/456

[58] Field of Search ..... 313/414, 417, 456

[56] References Cited

U.S. PATENT DOCUMENTS 4,323,813 4/1982 Vieland et al. ..... 313/456 X 4,668,892 5/1987 Peels ..... 313/414

*Primary Examiner*—Sandra L. O'Shea

*Attorney, Agent, or Firm*—Leydig, Voit & Mayer

[57] ABSTRACT

An electrode for electro gun of a cathode ray tube includes an external electrode member formed on the top of a cup-shaped body and having a large-diameter electron beam passing hole through which three electron beams pass commonly, and an internal electrode member inserted into the external electrode member and having three separate electron beam passing holes on the top of the internal electrode, wherein protrusions are formed on the outer surface of the internal electrode member, thereby enhancing the assembly precision of the external and internal electrode members.

6 Claims, 2 Drawing Sheets

ELECTRODE OF ELECTRON GUN FOR CATHODE RAY TUBE

BACKGROUND OF THE INVENTION

The present invention relates to an in-line electron gun for a color cathode ray tube, and more particularly to an electrode of an electron gun for forming a main electrostatic lens.

Typically, an electron gun is put into the neck of a CRT, and emits thermions for making a phosphor screen luminous. The ordinary structure of an electron gun includes a cathode, a control electrode and a screen electrode which constitute a triode, a focus electrode and a final accelerating electrode which form a main electrostatic lens, and a bead glass which fixes all of the components so as to be separated from one another by a specific distance.

In such a structure of the electron gun, an electron beam emitted from the cathode is previously focused and accelerated by means of a pre-focus lens formed between the screen electrode and focus electrode, and finally accelerated and focused by the main electrostatic lens formed between the focus electrode and final accelerating electrode. Then, the electron beam lands on the phosphor screen so as to form a pixel, a group of which make a picture. The resolution of the picture formed by a CRT depends on the forming state of the phosphor screen, the deflection of an electron beam by a deflection yoke of the CRT, and the focusing state of the electron beam emitted from the electron gun. Under these conditions, it is, above, all very important to improve the focusing state of the electron beam by means of the electrostatic lens formed between the electrodes of the electron gun so that the electron beam landing on the phosphor screen is formed as small and uniformly as possible.

For this, in a conventional method, the diameter of the electrostatic lens formed by the electrodes of the electron gun is enlarged to reduce the astigmatism of the electron beam and the spherical aberration of the electrostatic lens. This enhances the focusing characteristic of the electron beam.

FIG. 1 illustrates an example of an electrode which forms such a large-diameter electrostatic lens. A recess 12 through which three electron beams pass commonly is formed on the top of a nearly cup-shaped body 11. Three separate electron beam passing holes 14 are formed on the bottom 13 of recess 12.

In the conventional electrode 10, the diameter of an electrostatic lens becomes larger by means of recess 12 through which the three electron beams pass commonly. However, since the single body 11 is pressed to form recess 12, the fraction defective (the number of defective units per 100 units) increases because the processing of recess 12 and the evenness of the surfaces A—A′ and B—B′ shown in FIG. 1 are difficult to attain.

In order to overcome the problems, as shown in FIG. 2A, another conventional electrode comprises an external electrode member 20 having an electron beam passing hole 21 through which the three electron beams pass commonly, and an internal electrode member 30 inserted into external electrode member 20 and having three separate electron beam passing holes 31.

In such a conventional electrode, the evenness of the surfaces in which the electron beam passing holes are formed, is enhanced. However, when internal electrode member 30 is inserted into external electrode member 20, since the outer surface of internal electrode member 30 makes contact with the inner surface of external electrode member 20, the insertion is not smoothly carried out and internal electrode member 30 inserted into external electrode member 20 may be tilted or distorted. In forming internal electrode member 30 having three separate electron beam passing holes 31, as shown in FIG. 2B, a flare 22 is formed at the end of internal electrode 30, and creates a poor contact between external electrode member 20 and internal electrode member 30 which causes the fraction defective to increase during their welding.

SUMMARY OF THE INVENTION

Therefore, it is an object of the present invention to provide an electrode of an electron gun for a cathode ray tube which improves the assembly precision and welding of an external electrode member and an internal electrode member so as to sharply enhance the performance of an electron gun employing the electrode.

To accomplish the object, there is provided an electrode for electron gun of cathode ray tube comprising: an external electrode member formed on the top of a cup-shaped body and having a large-diameter electron beam passing hole through which three electron beams pass commonly; and an internal electrode member inserted into the external electrode member and having three separate electron beam passing holes on the top of the internal electrode, wherein protrusions are formed on the outer surface of the internal electrode member.

In the electrode for the electron gun of the cathode ray tube of the present invention, in forming the internal electrode member, the protrusions formed on the outer surface of the internal electrode member are formed higher than a flare formed at the end of a skirt portion.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1:
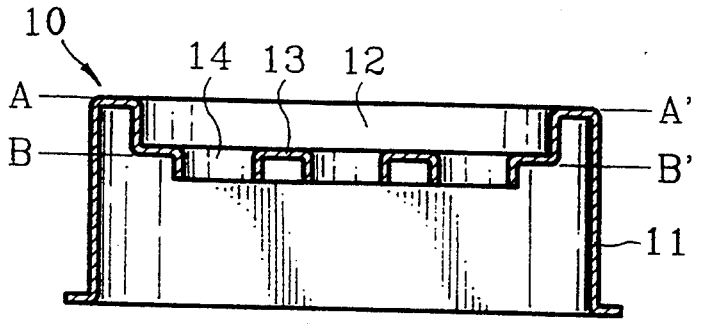
FIG. 1 (PRIOR ART)
FIG. 1 is a cross-sectional view of a conventional electrode of an electron gun for CRT.
Figure 2A:
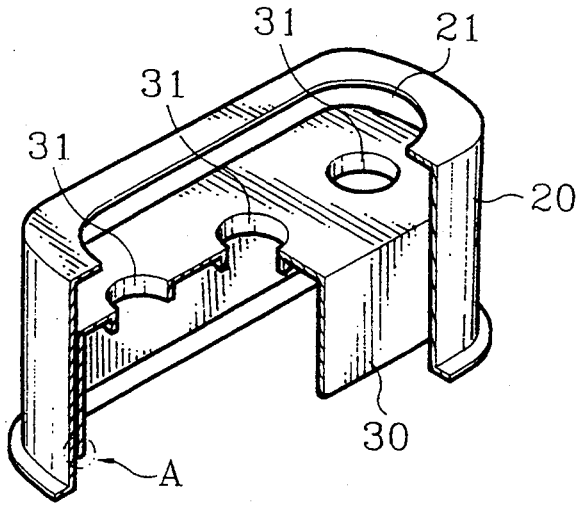
FIG. 2A (PRIOR ART)
FIG. 2A is a partially cutaway perspective view of another conventional electrode of an electron gun for CRT.
Figure 2B:
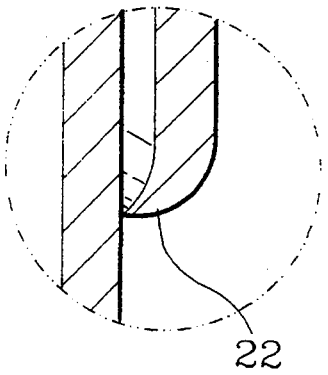
FIG. 2B (PRIOR ART)
FIG. 2B is an enlarged cross-sectional view of portion A shown in FIG. 2A.
Figure 3:
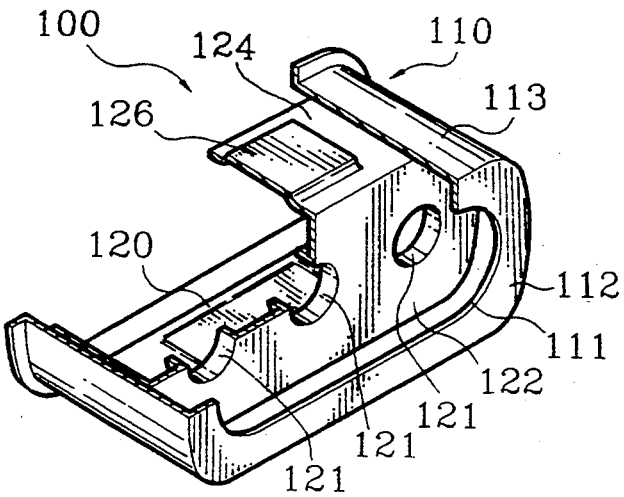
FIG. 3 is a partially cutaway perspective view of an electrode of an electron gun for CRT according to the present invention.
Figure 4:
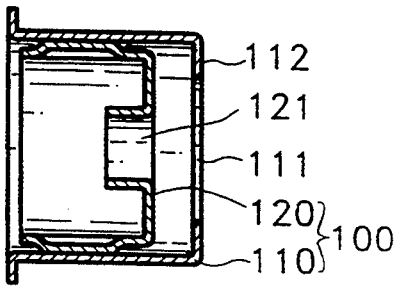
FIG. 4 is a cross-sectional view of the electrode of the electron gun for CRT shown in FIG. 3.
Figure 5:
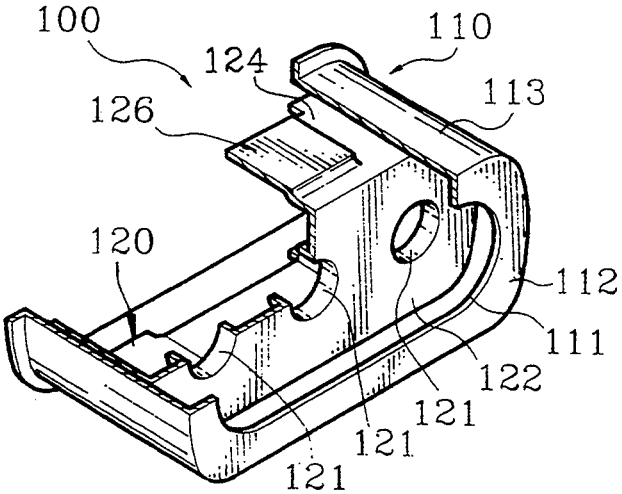
FIG. 5 is a cross-sectional view of another embodiment of the electrode of the electron gun for CRT according to the present invention.

Referring to FIG. 3, an electron gun for CRT of the present invention which forms a large-diameter electrostatic lens, comprises a cup-shaped external electrode member 110 and an internal electrode member 120 which is inserted into external electrode member 110.

External electrode member 110 has an electron beam passing face 112 in which a large-diameter electron beam passing hole 111 through which three electron beams pass commonly is formed, and a skirt portion 113 extended from the flange of electron beam passing face 112 by a specific length to be perpendicular thereto.

Internal electrode member 120 inserted into and welded to external electrode member 110 has an electron beam passing face 122 in which three electron beam passing holes 121 are formed so as to be spaced apart by a specific distance, and a skirt portion 124 extended by a specific length from the fringe of the electron beam passing face to be perpendicular thereto. As a feature of the present invention, a plurality of protrusions 126 of a specific height are formed on the outer surface of skirt portion 124 of internal electrode member 120. Here, it is desirable that the top of protrusions 126 be formed to have a plane adjoining the inner surface of external electrode member 110. The protrusions 126 should be of a height which establishes a satisfactory clearance between a flare formed at the end of skirt portion 124. More particularly, in the described embodiment, the height of the flare is about 0.05 mm and the height of the protrusions is in the range of 0.025–0.1 mm. Of course, these heights will vary because the height of the flare is determined according to design requirements of the electrode and according to moding conditions. Also, the height of protrusions 126 is determined by the height of the flare. It is further desirable that protrusions 126 be formed as a pair on the opposing portions of the outer surface of internal electrode member 120 and the lower end of protrusions 126 and the skirt portion extended therefrom be cut so as to facilitate a beading processing.

In the electrode 100 of electron gun for CRT according to the present invention, when internal electrode member 120 is inserted into external electrode member 110, the inner surface of external electrode member 110 makes contact with the surface of protrusions 126 formed on the skirt portion of internal electrode member 120 so as to prevent the space between internal electrode member 120 and external electrode member 110 from inconsistently becoming open and further prevent internal electrode member 120 from being tilted with respect to external electrode member 110. Since protrusions 126 of internal electrode member 120 are formed by bead-processing the skirt portion of internal electrode member 120, the electrode structure becomes strong to prevent the deformation of the electrode due to the external force. Therefore, different from the conventional method, it is unnecessary to flare the edge of the large-diameter electron beam passing hole in consideration of the deformation of external electrode member 120 due to the external force. Instead, the large-diameter electron beam passing hole can be enlarged as much as the size of the flare of the prior art. Further, when considering the evenness of internal electrode member 120, in order to be precisely inserted into external electrode member 110, only the evenness of protrusions 126 is concerned. This facilitates the precision control of internal electrode member 120, and, contrary to the conventional device which deals with the entire skirt portion of internal electrode member 120, raises productivity.

As described above, the electrode of an electron gun for CRT of the present invention improves the assembly precision and welding of external and internal electrode members so that the precision of an electrostatic lens formed by the electrode is increased, to thus enhance the performance of the electron gun employing the electrode.

What is claimed is:

1. An electrode for an electron gun of a cathode ray tube comprising:

an external electrode member having a cup-shaped body with a large-diameter electron beam passing hole; and an internal electrode member disposed within said external electrode member, said internal electrode member having three separate electron beam passing holes; and a plurality of protrusions formed on the outer surface of said internal electrode member which are contiguous to said external electrode member.

2. An electrode for an electron gun of a cathode ray tube as claimed in claim 1, wherein, said internal electrode member includes a skirt portion and a flare formed at the end of a skirt portion, the protrusions having a height greater than the flare.

3. An electrode for an electron gun of a cathode ray tube as claimed in claim 1, wherein said protrusions are formed on opposing portions of the outer surface of said skirt portion of said internal electrode member.

4. An electrode for an electron gun of a cathode ray tube as claimed in claim 2, wherein said protrusions are integrated with the skirt portion by bead-processing.

5. An electrode for an electron gun of a cathode ray tube as claimed in claim 2, wherein a lower end of the skirt portion around said protrusions is cut.

6. An electrode for an electron gun of a cathode ray tube comprising:

an external electrode member having a large-diameter electron beam passing hole;

an internal electrode member having three separate electron beam passing holes, said internal electrode disposed within said external electrode;

a plurality of protrusions, at least one protrusion being formed on a portion of said internal electrode member and at least one protrusion being formed on an opposing portion of said internal electrode, said plurality of protrusions having a planar surface which adjoins said external electrode member thus substantially reducing the likelihood said the internal electrode member will tilt relative to said external electrode member.

* * * * *